US010406412B2

(12) United States Patent
Wakabayashi et al.

(10) Patent No.: US 10,406,412 B2
(45) Date of Patent: Sep. 10, 2019

(54) GOLF CLUB SHAFT AND GOLF CLUB

(71) Applicant: FUJIKURA RUBBER LTD., Koto-ku, Tokyo (JP)

(72) Inventors: Masaki Wakabayashi, Saitama (JP); Yoshihito Kogawa, Saitama (JP)

(73) Assignee: FUJIKURA RUBBER LTD., Tokyo (JP)

( * ) Notice: Subject to any disclaimer, the term of this patent is extended or adjusted under 35 U.S.C. 154(b) by 0 days.

(21) Appl. No.: 15/754,704

(22) PCT Filed: Aug. 26, 2015

(86) PCT No.: PCT/JP2015/074000

§ 371 (c)(1),
(2) Date: Feb. 23, 2018

(87) PCT Pub. No.: WO2017/033307

PCT Pub. Date: Mar. 2, 2017

(65) Prior Publication Data

US 2018/0250563 A1 Sep. 6, 2018

(51) Int. Cl.
*A63B 53/10* (2015.01)
*A63B 60/42* (2015.01)
(Continued)

(52) U.S. Cl.
CPC ..... *A63B 53/10* (2013.01); *A63B 60/42* (2015.10); *A63B 2053/002* (2013.01);
(Continued)

(58) Field of Classification Search
CPC ... A63B 53/10; A63B 60/42; A63B 2053/002; A63B 2102/32; A63B 2209/02; A63B 2060/0081
See application file for complete search history.

(56) References Cited

U.S. PATENT DOCUMENTS 6,692,377 B2 * 2/2004 Galloway ..... A63B 53/10 473/321
2002/0052249 A1 5/2002 Oyama
2010/0234124 A1 9/2010 Wakabayashi et al.

FOREIGN PATENT DOCUMENTS

JP H10-155951 A 6/1998
JP H11-128417 A 5/1999
(Continued)

OTHER PUBLICATIONS
International Search Report for Application No. PCT/JP2015/074000 dated Nov. 24, 2015.

*Primary Examiner* — Stephen L Blau
(74) *Attorney, Agent, or Firm* — McCormick, Paulding & Huber LLP

(57) ABSTRACT

A metal foil satisfies following conditional equations (1), (2) and (3) to smoothly increase rigidity in the longitudinal direction of the shaft main body from a distal end side to a base end side while increasing a weight of a wound part of the metal foil $$0.50<Lmf/Ls \quad (1)$$

$$Lmr/Ls<0.90 \quad (2)$$

$$0.03<Wm/Ws<0.09 \quad (3)$$

where
Lmf: a length from a distal end position in the longitudinal direction of the shaft main body to a winding start position of the metal foil,
Lmr: a length from the distal end position in the longitudinal direction of the shaft main body to a winding end position of the metal foil,
Ls: a length of the shaft main body,
Wm: a weight of the metal foil, and
Ws: a weight of the shaft main body.

6 Claims, 15 Drawing Sheets

(51) Int. Cl.
*A63B 102/32* (2015.01)
*A63B 53/00* (2015.01)
*A63B 60/00* (2015.01)

(52) U.S. Cl.
CPC ... *A63B 2060/0081* (2015.10); *A63B 2102/32* (2015.10); *A63B 2209/02* (2013.01)

(56) References Cited

FOREIGN PATENT DOCUMENTS

| | | | | |
|---|---|---|---|---|
| JP | H11-285550 | A | | 10/1999 |
| JP | 2001-87424 | A | | 4/2001 |
| JP | 2002-85608 | A | | 3/2002 |
| JP | 2007-135811 | A | | 6/2007 |
| JP | 2007190107 | | * | 8/2007 |
| JP | 2007190107 | A | * | 8/2007 |
| JP | 2009-219564 | A | | 1/2009 |
| JP | 2013-27606 | A | | 7/2013 |
| JP | 2013-220285 | A | | 10/2013 |
| JP | 2013220285 | | * | 10/2013 |

* cited by examiner

Inner Layer (Lower Layer) ↕ Outer Layer (Upper Layer)

| Number | Prepreg | Angle(°) | Sheet Weight(g) | Prepreg Shape |
|---|---|---|---|---|
| 11 | Carbon | 0 | 1.78 | |
| 12 | Carbon | +45 | 15.27 | |
| 13 | Carbon | −45 | 15.27 | |
| 10M | Copper | 0 | 4.35 | |
| 14 | Carbon | 0 | 1.06 | |
| 15 | Carbon | 0 | 6.94 | |
| 16 | Carbon | 0 | 8.32 | |
| 17 | Carbon | 0 | 8.76 | |
| 18 | Carbon | 0 | 1.73 | |

| Number | Prepreg | Angle(°) | Sheet Weight(g) | Prepreg Shape |
|---|---|---|---|---|
| 11 | Carbon | 0 | 1.78 | |
| 12 | Carbon | +45 | 15.27 | |
| 13 | Carbon | −45 | 15.27 | |
| 10M | Copper | 0 | 4.19 | |
| 14 | Carbon | 0 | 1.06 | |
| 15 | Carbon | 0 | 6.94 | |
| 16 | Carbon | 0 | 8.32 | |
| 17 | Carbon | 0 | 8.66 | |
| 18 | Carbon | 0 | 1.73 | |

Inner Layer (Lower Layer) ⟷ Outer Layer (Upper Layer)

| Number | Prepreg | Angle(°) | Sheet Weight(g) | Prepreg Shape |
|---|---|---|---|---|
| 11 | Carbon | 0 | 1.78 | |
| 12 | Carbon | +45 | 15.27 | |
| 13 | Carbon | −45 | 15.27 | |
| 10M | Copper | 0 | 4.40 | |
| 14 | Carbon | 0 | 1.06 | |
| 15 | Carbon | 0 | 6.94 | |
| 16 | Carbon | 0 | 8.32 | |
| 17 | Carbon | 0 | 8.23 | |
| 18 | Carbon | 0 | 1.73 | |

Inner Layer (Lower Layer) ⟷ Outer Layer (Upper Layer)

FIG. 5

| Item | Entire Length | Tip Diameter(mm) | Butt Diameter(mm) | CPM | Weight Ws | Torque | K.P. | G.C.L | | Copper Foil Weight Wm | Wm / Ws | Copper Foil Lamination Position | | Lmf / Ls | Lmr / Ls | Lmt/Ls |
|---|---|---|---|---|---|---|---|---|---|---|---|---|---|---|---|---|
| | (mm) | T-10 | B-150 | | (g) | (deg) | | (mm) | (%) | (g) | | Start of Winding Lmf | End of Winding Lmr | | | |
| Second Embodiment | 1168 | 8.50 | 15.25 | 275 | 63.2 | 3.6 | 2.2 | 619 | 53.0 | 4.19 | 6.6% | 590 | 890 | 50.5% | 76.2% | 25.7% |
| First Embodiment | 1168 | 8.50 | 15.25 | 275 | 63.6 | 3.8 | 2.2 | 616 | 52.7 | 4.35 | 6.8% | 640 | 940 | 54.8% | 80.5% | 25.7% |
| Third Embodiment | 1168 | 8.50 | 15.30 | 275 | 63.0 | 3.6 | 2.2 | 628 | 53.8 | 4.40 | 7.0% | 740 | 1040 | 63.4% | 89.0% | 25.7% |

| Number | Material | Angle(°) | Sheet Weight(g) | Prepreg Shape |
|---|---|---|---|---|
| 11 | Carbon | 0 | 1.78 | |
| 12 | Carbon | +45 | 15.27 | |
| 13 | Carbon | −45 | 15.27 | |
| 14 | Carbon | 0 | 1.06 | |
| 15 | Carbon | 0 | 6.94 | |
| 16 | Carbon | 0 | 8.32 | |
| 17 | Carbon | 0 | 9.63 | |
| 18 | Carbon | 0 | 1.73 | |

Inner Layer (Lower Layer) ⟷ Outer Layer (Upper Layer)

Inner Layer (Lower Layer) ↕ Outer Layer (Upper Layer)

| Number | Prepreg | Angle(°) | Sheet Weight(g) | Prepreg Shape |
|---|---|---|---|---|
| 11 | Carbon | 0 | 1.78 | |
| 12 | Carbon | +45 | 15.27 | |
| 13 | Carbon | −45 | 15.27 | |
| 10M | Copper | 0 | 3.67 | |
| 14 | Carbon | 0 | 1.06 | |
| 15 | Carbon | 0 | 6.94 | |
| 16 | Carbon | 0 | 8.32 | |
| 17 | Carbon | 0 | 9.26 | |
| 18 | Carbon | 0 | 1.73 | |

Inner Layer (Lower Layer) ↕ Outer Layer (Upper Layer)

| Number | Prepreg | Angle(°) | Sheet Weight(g) | Prepreg Shape |
|---|---|---|---|---|
| 11 | Carbon | 0 | 1.78 | |
| 12 | Carbon | +45 | 15.27 | |
| 13 | Carbon | −45 | 15.27 | |
| 10M | Copper | 0 | 4.32 | |
| 14 | Carbon | 0 | 1.06 | |
| 15 | Carbon | 0 | 6.94 | |
| 16 | Carbon | 0 | 8.32 | |
| 17 | Carbon | 0 | 9.26 | |
| 18 | Carbon | 0 | 1.73 | |

FIG. 9

| Item | Entire Length | Tip Diameter(mm) | Butt Diameter(mm) | CPM | Weight Ws | Torque | K.P. | G.C.L | | Copper Foil Weight Wm | Wm / Ws | Copper Foil Lamination Position | | Lmf / Ls | Lmr / Ls | Lmt/Ls |
|---|---|---|---|---|---|---|---|---|---|---|---|---|---|---|---|---|
| | (mm) | T-10 | B-150 | | (g) | (deg) | | (mm) | (%) | (g) | | Start of Winding Lmf | End of Winding Lmr | | | |
| First Comparative Example | 1168 | 8.50 | 15.25 | 275 | 60.0 | 3.9 | 2.2 | 604 | 51.7 | | | | | | | |
| Second Comparative Example | 1168 | 8.50 | 15.25 | 275 | 63.3 | 3.7 | 2.3 | 601 | 51.5 | 3.67 | 5.8% | 390 | 690 | 33.4% | 59.1% | 25.7% |
| Third Comparative Example | 1168 | 8.50 | 15.35 | 275 | 64.0 | 3.7 | 2.2 | 631 | 54.0 | 4.66 | 7.3% | 890 | 1168 | 76.2% | 100.0% | 23.8% |

FIG. 14

| Tester | HS (m/s) | | | | TOTAL (yards) | | | |
|---|---|---|---|---|---|---|---|---|
| | First Comparative Example | Second Comparative Example | First Embodiment | Third Comparative Example | First Comparative Example | Second Comparative Example | First Embodiment | Third Comparative Example |
| A | 40.7 | 40.9 | 41.7 | 41.5 | 243.0 | 246.0 | 248.2 | 249.4 |
| B | 46.3 | 46.4 | 46.4 | 45.5 | 275.5 | 275.6 | 278.9 | 275.4 |
| C | 41.4 | 42.0 | 43.2 | 43.0 | 238.6 | 252.7 | 256.6 | 255.7 |
| D | 44.2 | 44.5 | 44.6 | 44.2 | 267.5 | 260.5 | 269.6 | 263.7 |
| E | 41.9 | 41.8 | 42.1 | 41.9 | 235.5 | 233.9 | 234.8 | 235.6 |
| F | 41.2 | 40.8 | 42.0 | 41.8 | 242.3 | 244.5 | 250.0 | 242.8 |
| G | 45.5 | 44.2 | 46.5 | 46.5 | 261.5 | 260.9 | 270.6 | 267.2 |
| H | 38.4 | 39.1 | 40.1 | 39.9 | 220.9 | 224.4 | 235.7 | 234.6 |
| I | 42.3 | 42.2 | 43.0 | 42.4 | 211.8 | 213.0 | 219.0 | 219.7 |
| J | 40.8 | 40.5 | 40.9 | 40.9 | 211.2 | 209.1 | 213.8 | 209.9 |
| | 42.3 | 42.2 | 43.1 | 42.8 | 240.8 | 242.1 | 247.7 | 245.4 |

FIG. 15

Easiness of Hitting (Scored Based on Perfect Score at 5 Points)

| Tester | First Comparative Example | Second Comparative Example | First Embodiment | Third Comparative Example |
|---|---|---|---|---|
| A | 3 | 2 | 5 | 4 |
| B | 3 | 4 | 5 | 4 |
| C | 3 | 2 | 4 | 5 |
| D | 3 | 3 | 5 | 4 |
| E | 3 | 3 | 4 | 5 |
| F | 3 | 3 | 5 | 3 |
| G | 3 | 4 | 5 | 3 |
| H | 3 | 5 | 4 | 4 |
| I | 3 | 2 | 5 | 4 |
| J | 3 | 2 | 4 | 5 |
| | 3.0 | 3.0 | 4.6 | 4.1 |

GOLF CLUB SHAFT AND GOLF CLUB

CROSS-REFERENCE TO RELATED APPLICATION

This application is entitled to the benefit of and incorporates by reference subject matter disclosed in the International Patent Application No. PCT/JP2015/074000 filed on Aug. 26, 2015, which is hereby incorporated by reference in its entirety.

TECHNICAL FIELD

The present invention relates to a golf club shaft and a golf club.

BACKGROUND ART

In recent years, golf club shafts are requested to increase a head speed even a little to extend a carry. Such golf club shafts for pursuing a carry generally tend to make it impossible to feel a peak of a flexure, and make it difficult to match a timing and make a shot.

Furthermore, various proposals have been made to provide a difference in rigidity in a length direction of a shaft to make it easy to make a shot. However, users have different preferences for the locally increased rigidity of the shaft.

PATENT LITERATURE

[Patent Literature 1] Japanese Patent Application Laid-Open No. 11-285550

[Patent Literature 2] Japanese Patent Application Laid-Open No. 2001-87424

SUMMARY

The present invention has been finished based on consciousness about the above problem. An object of the present invention is to provide a golf club shaft and a golf club that increase a head speed to extend a carry, and make it easy to match a timing and make a shot.

The inventors have found as a result of diligent studies that locating and winding a metal foil at and around a part in a longitudinal direction of a shaft main body, and optimally configuring various parameters such as a winding position, a winding length and the weight of this metal foil make it possible to smoothly increase rigidity in the longitudinal direction of the shaft main body from a distal end side to a base end side while increasing the weight of the wound part of the metal foil, and consequently provide a golf club shaft and a golf club that can increase a head speed to extend a carry, and make it easy to match a timing and make a shot.

A golf club shaft according to the present invention is a golf club shaft that includes a shaft main body formed by winding and thermally curing a prepreg made by impregnating reinforced fibers with a thermosetting resin, and in which a metal foil is located at and wound around a part in a longitudinal direction of the shaft main body, and the metal foil satisfies following conditional equations (1), (2) and (3) to smoothly increase rigidity in the longitudinal direction of the shaft main body from a distal end side to a base end side while increasing a weight of the wound part of the metal foil $$0.50<Lmf/Ls \quad (1)$$

$$Lmr/Ls<0.90 \quad (2)$$

$$0.03<Wm/Ws<0.09 \quad (3)$$

where

Lmf: a length from a distal end position in the longitudinal direction of the shaft main body to a winding start position of the metal foil, Lmr: a length from the distal end position in the longitudinal direction of the shaft main body to a winding end position of the metal foil, Ls: a length of the shaft main body, Wm: a weight of the metal foil, and Ws: a weight of the shaft main body.

A following conditional equation (1') in a condition range defined by the conditional equation (1) is preferably satisfied.

$$0.505<Lmf/Ls \quad (1')$$

A following conditional equation (2') in a condition range defined by the conditional equation (2) is preferably satisfied.

$$Lmr/Ls<0.890 \quad (2')$$

A following conditional equation (3') in a condition range defined by the conditional equation (3) is preferably satisfied.

$$0.039<Wm/Ws<0.069 \quad (3')$$

The golf club shaft according to the present invention preferably satisfies a following conditional equation (4).

$$0.05<Lmt/Ls<0.35 \quad (4)$$

where

Lmt: a length from the winding start position to the winding end position of the metal foil, and Ls: the length of the shaft main body.

A following conditional equation (4') in a condition range defined by the conditional equation (4) is preferably satisfied.

$$0.15<Lmt/Ls<0.25 \quad (4')$$

A density of the metal foil is preferably 7.5 g/cm$^3$ or more.

The metal foil is preferably a copper foil.

It is desirable for the shaft main body to include a pair of entire-length layers formed by thermally curing a pair of entire-length prepregs positioned at an inner layer side and at an outer layer side; and a distal-end partial layer formed by thermally curing a distal-end partial prepreg positioned between the pair of entire-length layers at the distal end, wherein the metal foil is positioned at the base end between the pair of entire-length layers, and the distal-end partial layer and the metal foil are arranged not to mutually overlap at the distal end nor at the base end with respect to a same lamination area between the pair of entire-length layers.

A golf club according to the present invention is formed by attaching a club head and a grip to one of the above golf club shafts.

The present invention provides a golf club shaft and a golf club that increase a head speed to extend a carry, and make it easy to match a timing and make a shot.

BRIEF DESCRIPTION OF DRAWINGS

FIG. 5 is a table illustrating a corresponding numerical value of each parameter of conditional equations (1) to (4) of the golf club shafts according to the first embodiment to the third embodiment.

FIG. 9 is a table illustrating a corresponding numerical value of each parameter of conditional equations (1) to (4) of the golf club shafts according to the first comparative example to the third comparative example.

FIG. 14 is a table illustrating head speeds and carries obtained when the testers made the test shots by using the golf club shaft according to the first embodiment and the golf club shafts according to the first to third comparative examples.

FIG. 15 is a table illustrating scores of hitting feelings obtained when the testers made the test shots by using the golf club shaft according to the first embodiment and the golf club shafts according to the first to third comparative examples.

DETAILED DESCRIPTION

First Embodiment

Figure 1:
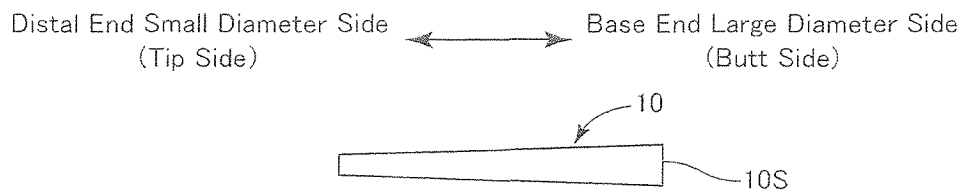
FIG. 1 is a view illustrating a configuration of a golf club shaft according to a first embodiment.

FIG. 1 illustrates a golf club shaft 10 according to the first embodiment. The golf club shaft 10 is formed in a tapered cylindrical shape whose outer diameter is gradually made larger from a distal end small diameter side (tip side) to a base end large diameter side (butt side). The golf club shaft 10 is formed as a golf club by attaching a club head (not illustrated) to a small diameter side distal end portion and attaching a grip (not illustrated) to a large diameter side base end portion.

The golf club shaft 10 includes a shaft main body 10S formed by winding and thermally curing prepregs made by impregnating reinforced fibers (carbon fibers herein) with a thermosetting resin. More specifically, the shaft main body 10S is formed by winding and thermally curing prepregs 11 to 18 around a tapered mandrel (not illustrated) from an inner layer (lower layer) to an outer layer (upper layer) in order.

The prepreg 11 is a 0° prepreg whose fiber direction is parallel to a shaft longitudinal direction, and is a distal end reinforcing layer of the shaft main body 10S. The prepregs 12 and 13 are bias prepregs whose fiber directions are +45° and −45° with respect to the shaft longitudinal direction, and are entire length layers of the shaft main body 10S. The prepreg 14 is a 0° prepreg whose fiber direction is parallel to the shaft longitudinal direction, and is a partial layer that constitutes approximately half of the distal end side of the shaft main body 10S. The prepregs 15, 16 and 17 are 0° prepregs whose fiber directions are parallel to the shaft longitudinal direction, and are entire length layers of the shaft main body 10S. The prepreg 18 is a 0° prepreg whose fiber direction is parallel to the shaft longitudinal direction, and forms the distal end portion of the shaft main body 10S as a straight portion corresponding to a hosel diameter of the club head. The entire length prepregs 12, 13, 15, 16 and 17 are formed in trapezoidal shapes that narrow from the large diameter end base end portion toward the small diameter distal end portion such that the numbers of turns become the same when the entire length prepregs 12, 13, 15, 16 and 17 are wound around the mandrel (not illustrated).

A metal foil (a copper foil in this case) 10M is wound between the prepreg 13 and the prepreg 15 and is located at a part (a part in the longitudinal direction of the shaft main body 10S) on the base end side without overlapping the prepreg 14. That is, the prepreg 14 and the metal foil 10M are disposed in the same lamination area. The prepreg 14 is disposed closer to the distal end side than a shaft intermediate portion. The metal foil 10M is disposed closer to the base end side than the shaft intermediate portion. The metal foil 10M has adequate softness produced by an elastic force, and can be wound around the mandrel (not illustrated) with good operability in the same way as the prepregs 11 to 18.

Second Embodiment

Figure 2:
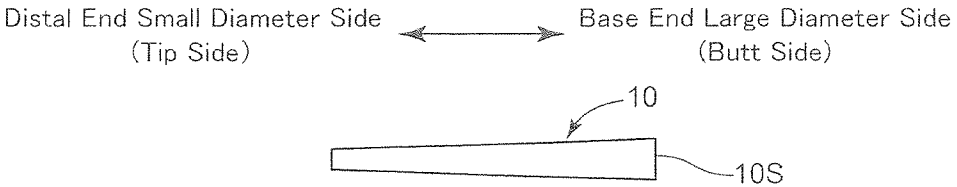
FIG. 2 is a view illustrating a configuration of a golf club shaft according to a second embodiment.

FIG. 2 illustrates a golf club shaft 10 according to the second embodiment. This second embodiment employs a basic configuration of the golf club shaft 10 according to the first embodiment where the weight of a metal foil (copper foil) 10M is slightly reduced to shift to a lower limit side (i.e., a distal end side) of a conditional equation (1) in a range satisfying the conditional range (1), and the weight of a prepreg 17 is slightly reduced.

Third Embodiment

Figure 3:
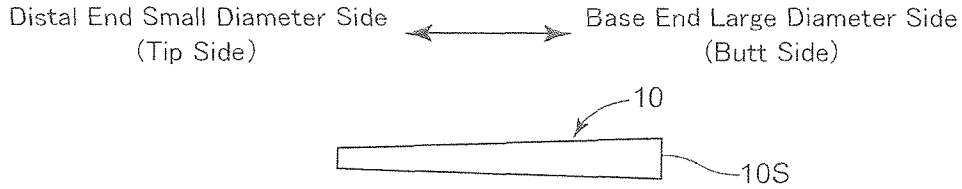
FIG. 3 is a view illustrating a configuration of a golf club shaft according to a third embodiment.

FIG. 3 illustrates a golf club shaft 10 according to the third embodiment. This third embodiment employs a basic configuration of the golf club shaft 10 according to the first embodiment where the weight of a metal foil (copper foil) 10M is slightly increased to shift to an upper limit side (i.e., base end side) of a conditional equation (1) in a range satisfying the conditional equation (1), and the weight of a prepreg 17 is slightly reduced.

The golf club shafts 10 according to the first embodiment to the third embodiment include the metal foil 10M in a part on a base end side of a shaft main body 10S. The metal foil 10M is preferably made of a material that has 7.5 g/cm$^3$ or more in density. In the present embodiment, a copper foil is used as the metal foil 10M satisfying these three conditions. The copper foil has 8.94 g/cm$^3$ in density. The copper foil satisfying the three conditions is used as the metal foil 10M, so that it is possible to increase the weight without partially changing an EI.

In this regard, the metal foil 10M does not necessarily need to satisfy the three conditions, and can be made of various materials such as tungsten, stainless steel and titanium other than the copper foil.

One of features of the golf club shafts 10 according to the first embodiment to the third embodiment is to satisfy the conditional equations (1), (2) and (3) to smoothly increase the rigidity in a longitudinal direction of the shaft main body 10S from a distal end side to a base end side while increasing the weight of a winding part of the metal foil 10M. The function and effect can be more remarkably obtained when a conditional equation (4) is satisfied.

Figure 4:
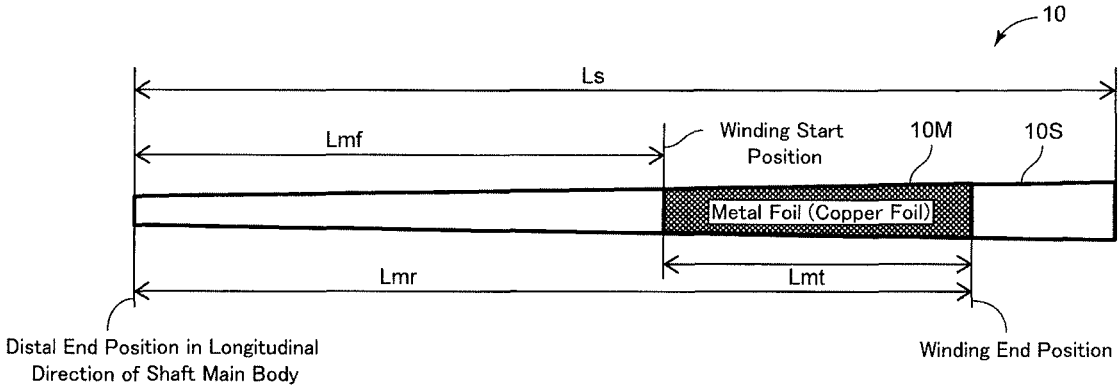
FIG. 4 is a view for explaining each parameter of conditional equations (1), (2) and (4).

As illustrated in FIGS. 4 and 5, according to the conditional equation (1), a length Lmf from a distal end position in the longitudinal direction of the shaft main body 10S to a winding start position of the metal foil 10M is divided by a length Ls of the shaft main body 10S. According to the conditional equation (2), a length Lmr from the distal end position in the longitudinal direction of the shaft main body 10S to a winding end position of the metal foil 10M is divided by the length Ls of the shaft main body. That is, the conditional equations (1) and (2) define the winding position (winding range) of the metal foil 10M that occupies the shaft main body 10S.

When the winding position satisfies the conditional equations (1) and (2), the hitting feeling becomes good, and a head speed increases.

When the winding position goes below the lower limit of the conditional equation (1), the hitting feeling becomes poor, and the head speed decreases.

When the winding position exceeds the upper limit of the conditional equation (2), the hitting feeling becomes poor, and the head speed decreases.

As illustrated in FIG. 5, the conditional equation (3) defines a ratio of a weight Wm of the metal foil 10M and a weight Ws of the shaft main body 10S.

When the ratio satisfies the conditional equation (3), the hitting feeling becomes good, and the head speed increases.

When the ratio exceeds the upper limit of the conditional equation (3), the shaft weight becomes heavy, and the head speed decreases.

When the ratio goes below the lower limit of the conditional equation (3), it is not possible to obtain the effect that the hitting feeling becomes good and the head speed increases.

As illustrated in FIGS. 4 and 5, according to the conditional equation (4), a length Lmt (=Lmr−Lmf) from the winding start position to the winding end position of the metal foil 10M is divided by the length Ls of the shaft main body 10*s*. That is, the conditional equation (4) defines a winding length of the metal foil 10M that occupies the shaft main body 10S.

When the winding length satisfies the conditional equation (4), the hitting feeling becomes good, and the head speed increases.

When the winding length exceeds the upper limit of the conditional equation (4), the shaft weight becomes heavy, and the head speed decreases.

When the winding length goes below the lower limit of the conditional equation (4), it is not possible to obtain the effect that the hitting feeling becomes good, and the head speed increases.

First Comparative Example

Figure 6:
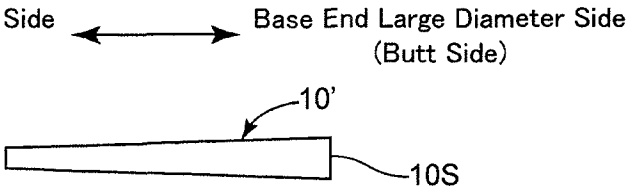
FIG. 6 is a view illustrating a configuration of a golf club shaft according to a first comparative example.

FIGS. 6 and 9 illustrate a golf club shaft 10' according to the first comparative example. This first comparative example employs the basic configuration of a golf club shaft 10 according to the first embodiment to the third embodiment where a metal foil (copper foil) 10M is omitted, and the weight of a prepreg 17 is slightly increased.

Second Comparative Example

Figure 7:
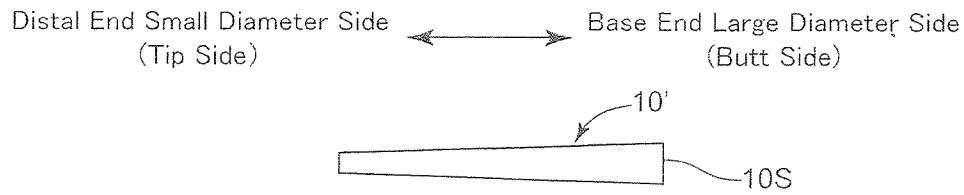
FIG. 7 is a view illustrating a configuration of a golf club shaft according to a second comparative example.

FIGS. 7 and 9 illustrate a golf club shaft 10' according to the second comparative example. This second comparative example employs the basic configuration of a golf club shaft 10 according to the first embodiment to the third embodiment where the weight of a metal foil (copper foil) 10M is slightly reduced to shift to a distal end side to go below a lower limit of a conditional equation (1), and the weight of a prepreg 17 is slightly increased.

Third Comparative Example

Figure 8:
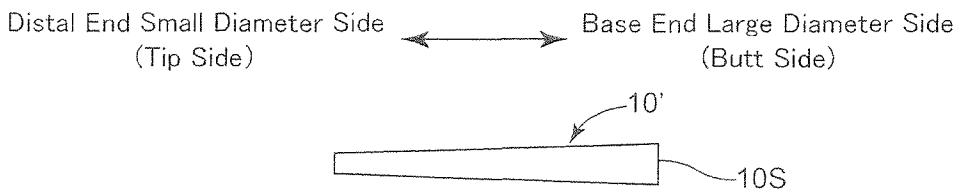
FIG. 8 is a view illustrating a configuration of a golf club shaft according to a third comparative example.

FIGS. 8 and 9 illustrate a golf club shaft 10' according to the third comparative example. This third comparative example employs the basic configuration of a golf club shaft 10 according to the first embodiment to the third embodiment where the weight of a metal foil (copper foil) 10M is slightly reduced to shift to a base end side to exceed an upper limit of a conditional equation (2), and the weight of a prepreg 17 is slightly increased.

Figure 10:
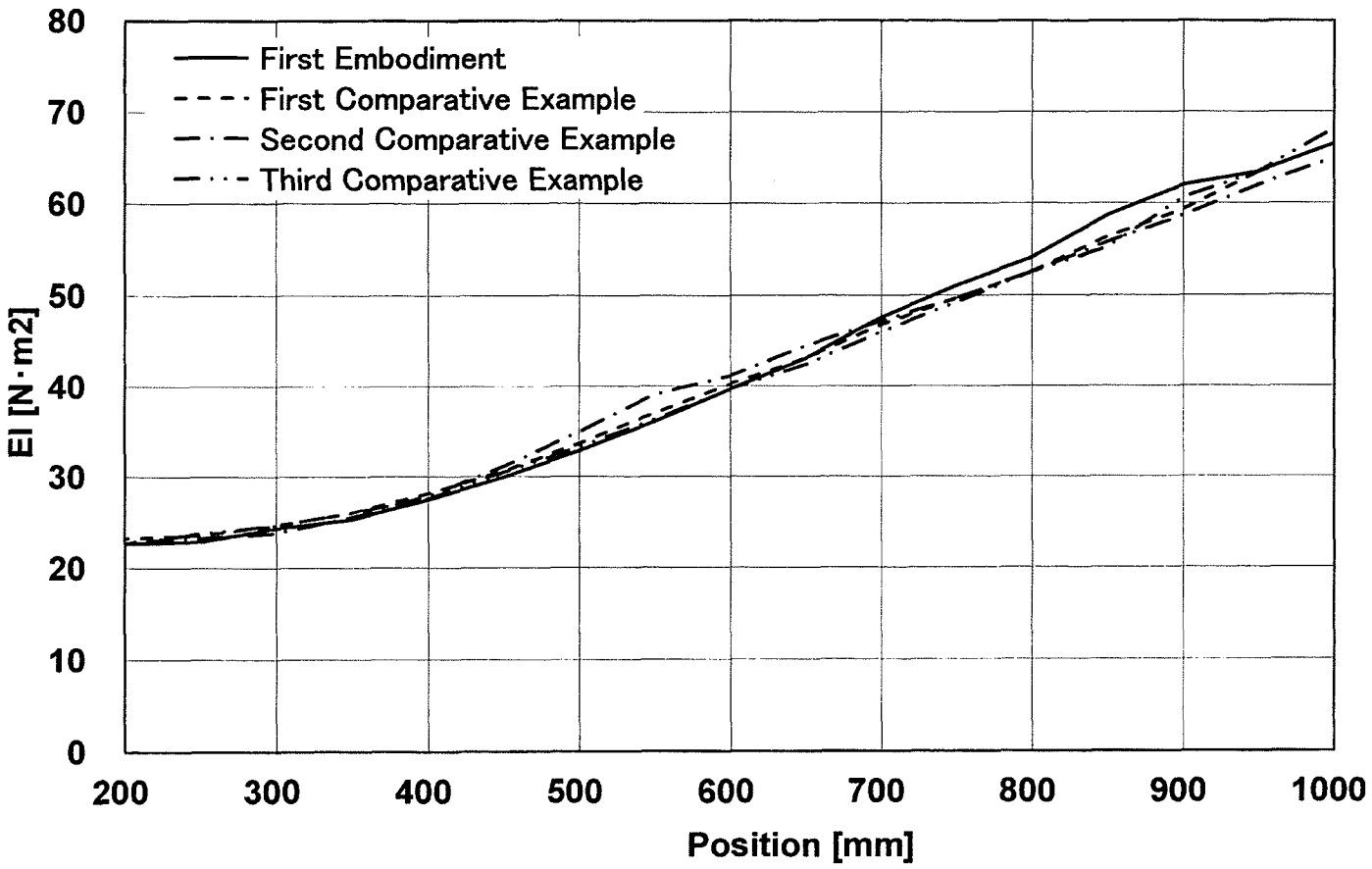
FIG. 10 is a graph chart illustrating characteristics of EI values in a longitudinal direction of the golf club shaft according to the first embodiment and the golf club shafts according to the first to third comparative examples.

Comparison and Study of Golf Club Shaft 10 According to First Embodiment and Golf Club Shafts 10' According to First to Third Comparative Examples FIG. 10 illustrate characteristics of EI values in a longitudinal direction of the golf club shaft 10 according to the first embodiment and the golf club shafts 10' according to the first to third comparative examples. As illustrated in FIG. 10, even at which position the metal foil (copper foil) is wound the EI values do not change.

Figure 11:
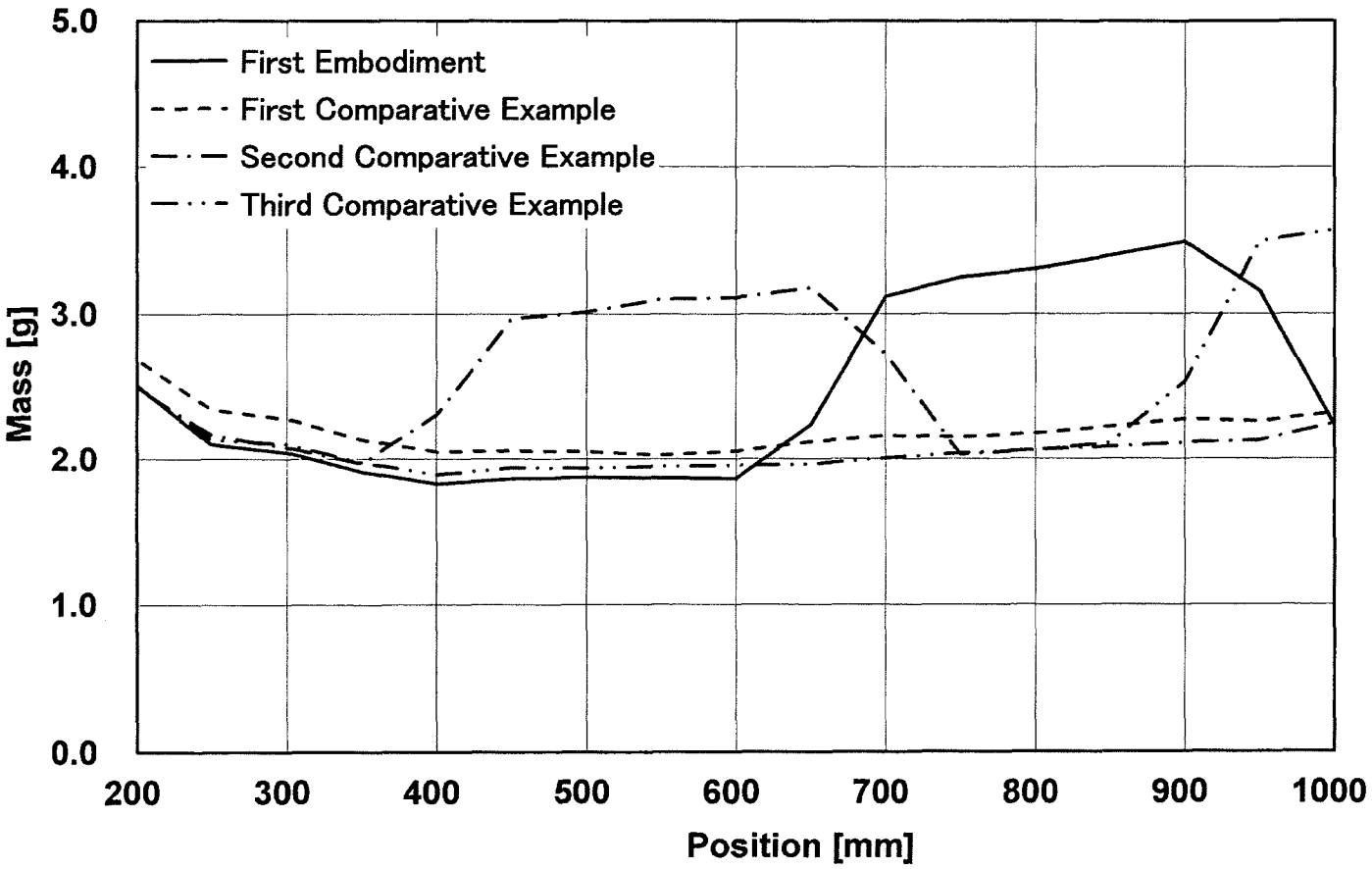
FIG. 11 is a graph chart illustrating characteristics of MASS values in the longitudinal direction of the golf club shaft according to the first embodiment and the golf club shafts according to the first to third comparative examples.

FIG. 11 illustrates characteristics of MASS values in the longitudinal direction of the golf club shaft 10 according to the first embodiment and the golf club shafts 10' according to the first to third comparative examples. As illustrated in FIG. 11, only the mass of a part wound by the metal foil (copper foil) increases.

<<Test Shot Results of Testers>>

The inventors actually made the golf club shaft 10 according to the first embodiment and the golf club shafts 10' according to the first to third comparative examples, and ten testers A, B, C, D, E, F, G, H, I and J who were golf experts conducted test shots. FIGS. 12 to 15 illustrate test shot results.

Figure 12:
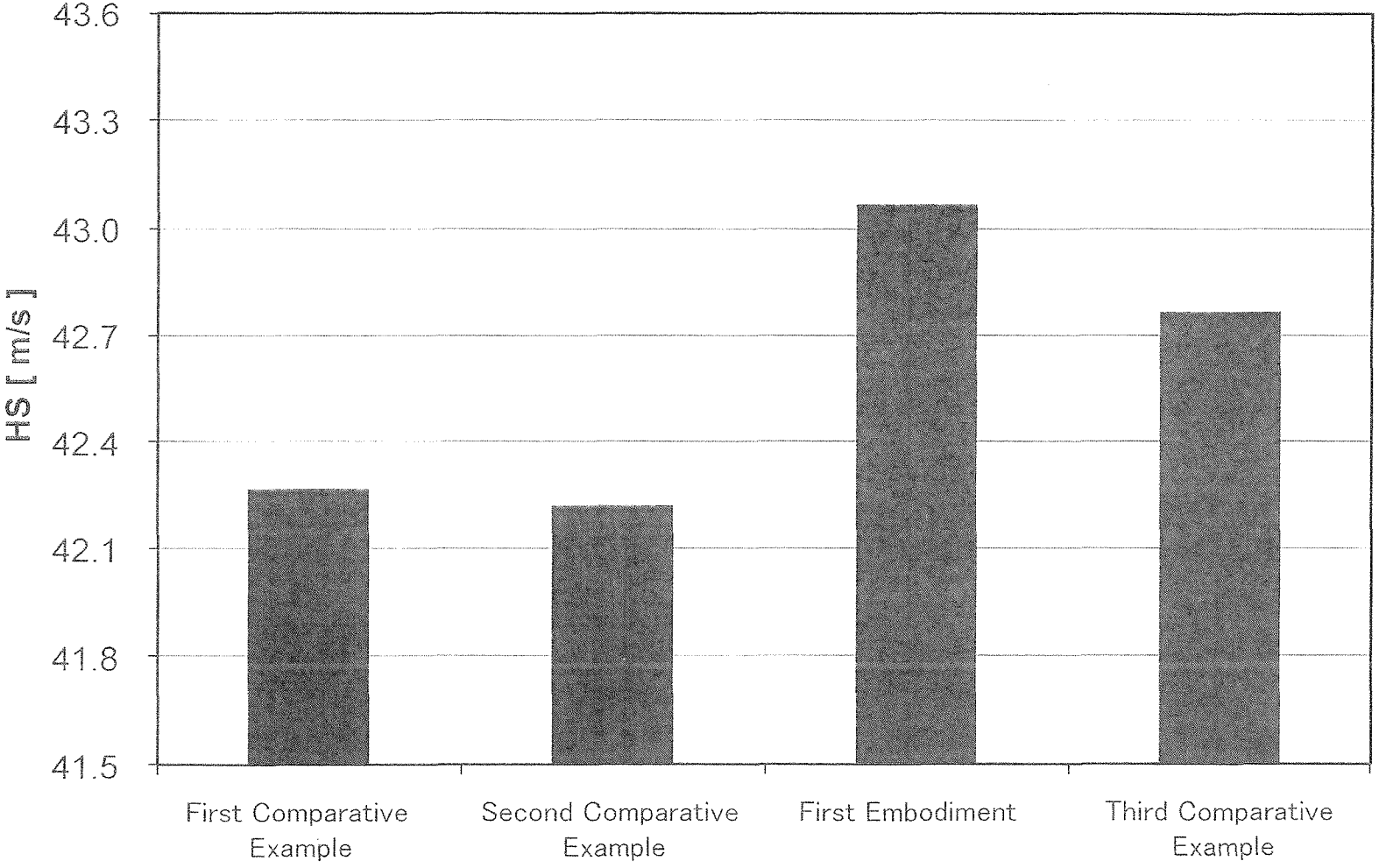
FIG. 12 is a graph chart illustrating head speeds obtained when testers made test shots by using the golf club shaft according to the first embodiment and the golf club shafts according to the first to third comparative examples.
Figure 13:
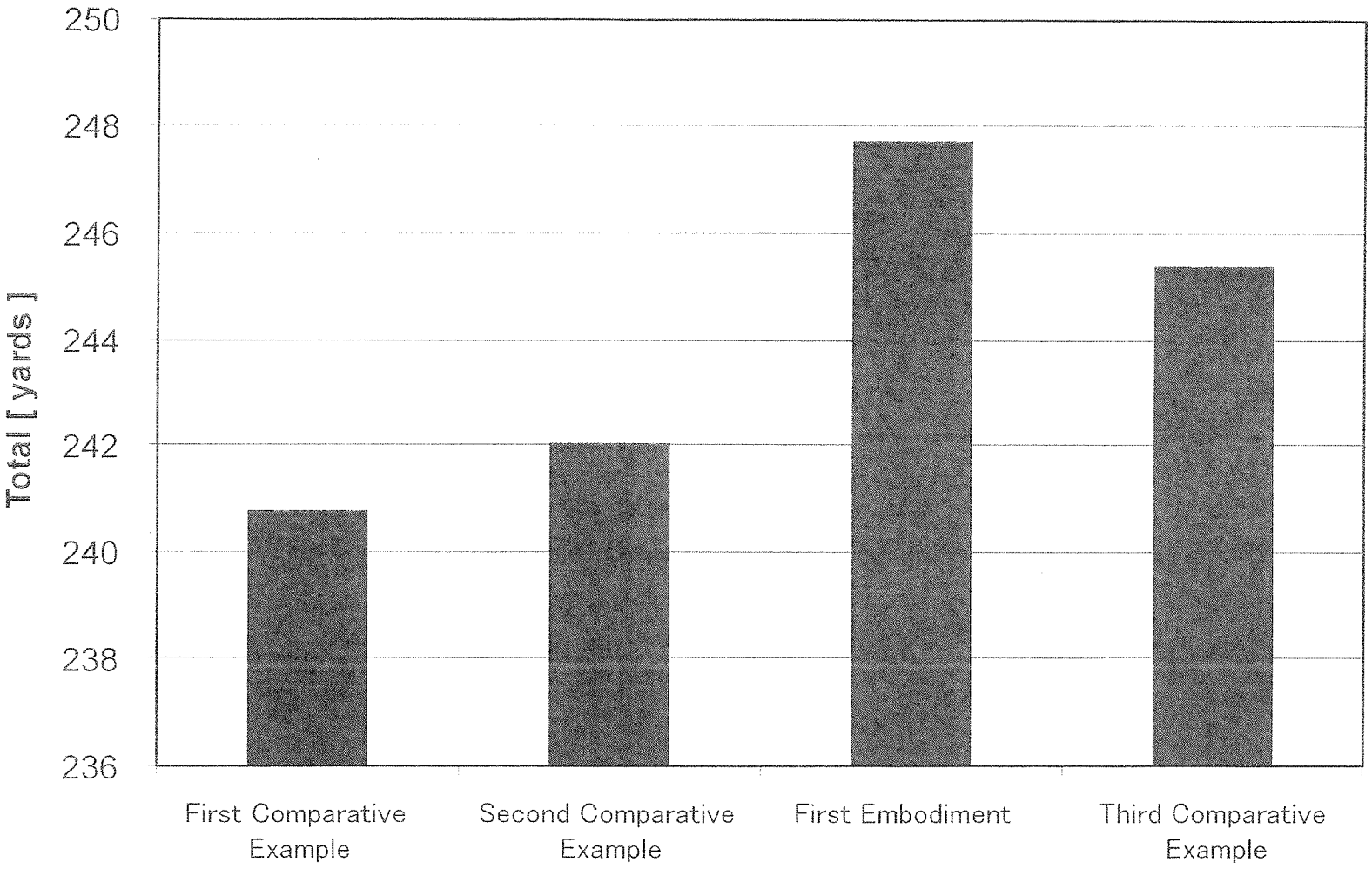
FIG. 13 is a graph chart illustrating carries obtained when the testers made the test shots by using the golf club shaft according to the first embodiment and the golf club shafts according to the first to third comparative examples.

FIGS. 12 to 14 illustrate head speeds and carries obtained when the testers made the test shots by using the golf club shaft 10 according to the first embodiment and the golf club shafts 10' according to the first to third comparative examples. As illustrated in FIGS. 12 to 14, both of the head speed and the carry of the golf club shaft 10 according to the first embodiment substantially exceed those of the golf club shafts 10' according to the first to third comparative examples.

FIG. 15 illustrates that the ten testers scored hitting feelings of the golf club shaft 10 according to the first embodiment and the golf club shafts 10' according to the first to third comparative examples based on the perfect score at five points. As illustrated in FIG. 15, score average values of the ten testers are 3.0 points in a case of the golf club shafts according to the first comparative example and the second comparative example, 4.1 points in a case of the golf club shaft 10' according to the third comparative example, and 4.6 points that are a very high score in a case of the golf club shaft 10 according to the first embodiment.

The golf club shaft and the golf club according to the present invention are suitably used in an industry of golf club shafts and golf clubs.

Although various embodiments of the present invention have been described and shown, the invention is not restricted thereto, but may also be embodied in other ways within the scope of the subject-matter defined in the following claims.

What is claimed is:

1. A golf club shaft comprising a shaft main body formed by winding and thermally curing a prepreg made by impregnating reinforced fibers with a thermosetting resin, wherein a metal foil is located at and wound around a part in a longitudinal direction of the shaft main body, and wherein the shaft main body comprises:

a pair of entire-length layers formed by thermally curing a pair of entire-length prepregs positioned at an inner layer side and at an outer layer side; and a distal-end partial layer formed by thermally curing a distal-end partial prepreg positioned between the pair of entire-length layers at the distal end, wherein the metal foil is positioned near the base end between the pair of entire-length layers, and wherein the distal-end partial layer and the metal foil are arranged not to mutually overlap at the distal end nor at the base end with respect to a same lamination area between the pair of entire-length layers, and wherein the metal foil satisfies following conditional equations (1), (2) and (3) to smoothly increase rigidity in the longitudinal direction of the shaft main body from a distal end side to a base end side while increasing a weight of the wound part of the metal foil $$0.50<Lmf/Ls \quad (1)$$

$$Lmr/Ls<0.90 \quad (2)$$

$$0.03<Wm/Ws<0.09 \quad (3)$$

where

Lmf: a length from a distal end position in the longitudinal direction of the shaft main body to a winding start position of the metal foil, Lmr: a length from the distal end position in the longitudinal direction of the shaft main body to a winding end position of the metal foil, Ls: a length of the shaft main body, Wm: a weight of the metal foil, and Ws: a weight of the shaft main body.

2. The golf club shaft according to claim 1, wherein a following conditional equation (4) is satisfied $$0.05<Lmt/Ls<0.35 \quad (4)$$

where

Lmt: a length from the winding start position to the winding end position of the metal foil, and Ls: the length of the shaft main body.

3. The golf club shaft according to claim 1, wherein a density of the metal foil is 7.5 g/cm$^3$ or more.

4. The golf club shaft according to claim 1, wherein the metal foil is a copper foil.

5. A golf club that is formed by attaching a club head and a grip to the golf club shaft according to claim 1.

6. The golf club shaft according to claim 1, wherein a following conditional equation (3') is satisfied:

$$0.039<Wm/Ws<0.069 \quad (3').$$

* * * * *